United States Patent [19]

Istrati et al.

[11] Patent Number: 4,468,036

[45] Date of Patent: Aug. 28, 1984

[54] BOARD GAME APPARATUS

[76] Inventors: Konrad C. Istrati; Delilah J. Istrati, both of Box 554, Assiniboia, Saskatchewan, Canada, S0H 0B0

[21] Appl. No.: 458,471

[22] Filed: Jan. 17, 1983

[51] Int. Cl.[3] ..... A63F 3/00

[52] U.S. Cl. ..... 273/271; 273/153 S

[58] Field of Search ..... 273/153 S, 241, 271

[56] References Cited

U.S. PATENT DOCUMENTS

| | | | |
|---|---|---|---|
| 2,409,144 | 10/1946 | Mills | 273/271 |
| 3,705,727 | 12/1972 | Breslow | 273/271 |
| 4,303,246 | 12/1981 | Strongin | 273/271 |

FOREIGN PATENT DOCUMENTS

| | | | |
|---|---|---|---|
| 1244174 | 8/1971 | United Kingdom | 273/271 |

*Primary Examiner*—Harland S. Skogquist
*Attorney, Agent, or Firm*—Stanley G. Ade

[57] ABSTRACT

A board game apparatus comprises a pair of flat plain plates in spaced parallel configuration between which are mounted a number of counters in rows and columns defining a surface pattern. Flexible laminate strips adjacent the edges of the pattern define the extreme positions of the counters and maintain them in position between the plates. The strips are divided into separate portions which can be depressed manually for the insertion of an additional counter into a row or column and the ejection of the last counter in the opposite end of the row or column. The plates are connected flexibly by leaf springs to maintain pressure on the counters while allowing some flexibility for the ejection and insertion movements.

14 Claims, 3 Drawing Figures

BOARD GAME APPARATUS

BACKGROUND OF THE INVENTION

This invention relates to a board game apparatus particularly of the kind which can be used in patience-type games where a player can play on his own and can put down the game at any time and revert to it at will.

Patience games of this type have been known for a very long time and have always found great favour with the public for passing idle moments. Games of this sort are particularly advantageous if they can be picked up and put down at will without the necessity for resetting up the game whenever it is picked up after a period of disuse. The most successful of games of this sort in recent years has been the Rubik cube, however many other games of this sort using coloured surfaces of blocks or articles have been available.

Other types of board games have been developed where counters or blocks are moved across a surface and usually these are competitive games requiring two players. One example of such a board game is disclosed in U.S. Pat. No. 4,303,246 (Strongin). In this apparatus a plurality of tracks arranged in rows and columns is defined between two plates one of which is transparent. Each player is then provided with a plurality of blocks with a surface having a visible characteristic such as a colour or marking to identify the player's blocks. The players then in turn insert blocks into the tracks between the two plates in such a way that a new block inserted acts to move any remaining blocks in a column or row in which the block is inserted and to eject the last block in the row or column if the row or column is full. In a game similar to naughts and crosses, the first player to complete a solid row or column or diagonal with his blocks is declared the winner. Such an apparatus is entirely satisfactory when used as a competitive game in which the players must sit down specifically to play the game and remain playing until the game is complete. However, it is unsatisfactory as a patience-type game because it requires to be set up afresh each time the game is picked up.

SUMMARY OF THE INVENTION

It is one object of the invention therefore to provide a board game apparatus of the type wherein blocks or counters can be moved in columns and rows and wherein the apparatus can be set down and taken up at will without the necessity for resetting.

It is a further object of the invention to provide an apparatus which is of simple and inexpensive construction and yet provides a robust apparatus which can be transported and handled without disturbing the structure of the game.

It is a yet further object of the invention to provide an apparatus of the above type which does not require the necessity of defined tracks for the movement of the blocks or counters and thus is simple to manufacture and also the blocks are free to move in defined paths without the necessity of accurate location. In addition the blocks are themselves of simple construction without the necessity of portions which cooperate with defined tracks.

It is a yet further object of the invention to provide an apparatus which locates the blocks in stored positions and also provides additional storage space for additional blocks.

Accordingly, the invention provides a board game apparatus comprising a first plate and a second plate, means mounting the plates in parallel and spaced relation, a plurality of separate square blocks which can be mounted between the plates in rows and columns such that in turn each row and each column of such blocks can be moved along its length by the introduction of a further block at one end to eject a block at the other end and trap means arranged at the end of each column and each row normally retaining the blocks in position between the plates, which trap means is individually manually movable to a release position to allow a block to be inserted into the plates and to allow a block to be ejected from between the plates.

With the foregoing in view, and other advantages as will become apparent to those skilled in the art to which this invention relates as this specification proceeds, the invention is herein described by reference to the accompanying drawings forming a part hereof, which includes a description of the best mode known to the applicants and of the preferred typical embodiment of the principles of the present invention, in which:

DESCRIPTION OF THE DRAWINGS

In the drawings like characters of reference indicate corresonding parts in the different figures.

DETAILED DESCRIPTION

Figure 1:
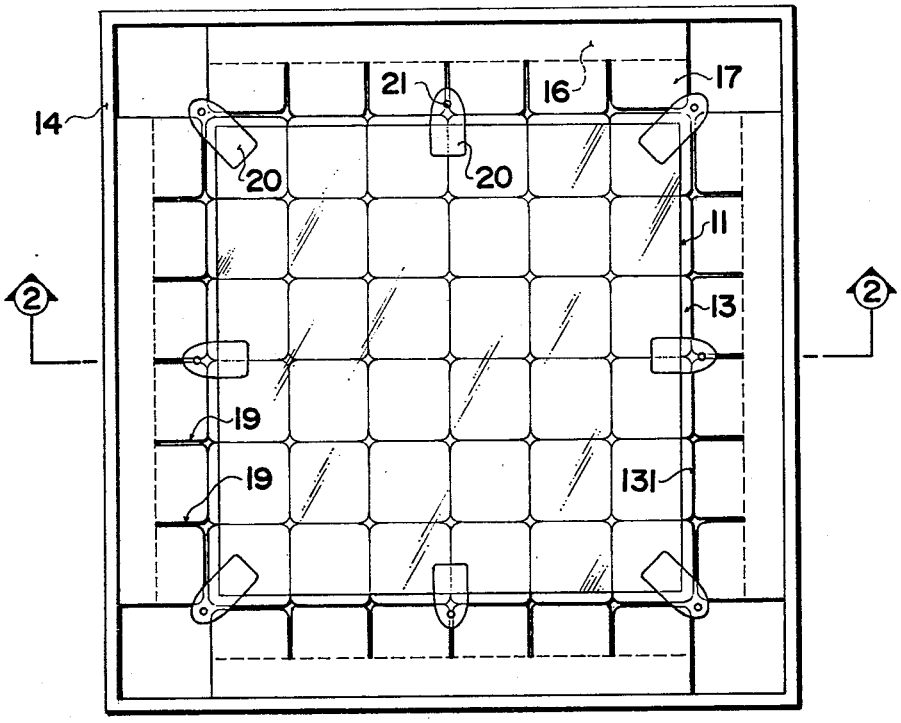
FIG. 1 is a plan view of the apparatus.

The board game apparatus comprises basically a pair of parallel spaced plates 11 and 12 sandwiching between them a plurality of counters or blocks 13. The plate 11 is transparent and for this purpose is formed of plexiglass so as to show the configuration of the counters 13 and the plate 12 is similarly of plexiglass or similar material so as to form a base structure for the counters.

The construction of the apparatus is formed firstly by a main body 121 which is square of, for example, 7½ inches along the side and carries upstanding side walls 14 along each side. To form a rigid structure, there is provided a retaining strip 15 along the junction between the main body and each wall with the strip 15 glued to both the wall and the base. Thus there is formed substantially a box with open top which contains the apparatus and provides a protective surround to inhibit damage or disturbance to the counters and their configuration. On top of the main body 121 is provided the plate 12 which is co-extensive therewith and along each edge of the plate 12 adjacent the side wall is provided a stip 16 of the order of ½ inch wide, which strip extends along the full length of the side and is secured to the base preferably by glueing or other suitable means. On top of each strip 16 is secured a further strip 17 which, as explained hereinafter, forms a movable latch for the counters or blocks 13. The strip 17 is formed of a ceramic laminate material so that it is readily flexible and is secured to the upper surface of the strip 16 by adhesive. A portion of the strip 17 extends beyond the strip 16 and is of a sufficient length to just reach the edge of the adjacent row or column of counters.

As shown more clearly in FIG. 1, the counters or blocks 13 are arranged in rows and columns to form a square pattern. In this example, there are 36 such counters but it will be apparent that any number of counters could be used either in a square or in a rectangle or even another shape which allows the formation of columns and rows. The thicknesses of the strips 16 and 17 are chosen such that the edge of the strip 17 contacts the side wall 131 of the adjacent counters. Thus each strip 17 therefore is substantially co-extensive with the adjacent column or row of counters so that the edge of the strip 17 contacts or lies closely adjacent the outside edge of each of the counters in that particular column or row. The strips 17 cooperate to define the outermost extent of the counters 13 so that they are effectively retained against movement parallel to the plates 11 and 12. In this way, the counters are retained in their columns and rows and their configuration is maintained despite any movement of the apparatus as a whole.

Figure 2:
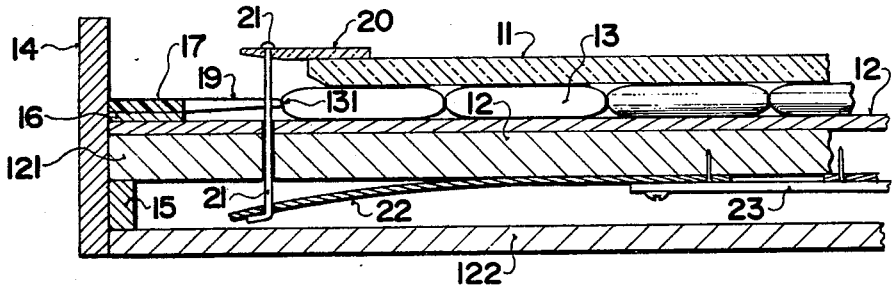
FIG. 2 is a section along the line 2—2 of FIG. 1.

Each strip 17 is cut in a direction at right angles to the edge of the adjacent column or row of counters. These cuts, indicated at 19, line along the lines of intersection of the counters and extend to the edge of the strip 16. In this way, each strip 17 is divided effectively into a separate portion for each of the counters in the adjacent column or row whereby each portion contacts only one such counter. It will be noted from FIG. 2 that the lower edge of the strip 17 is chamfered adjacent the adjacent counter 13, each counter is chamfered at its lower and upper outside edges and the lower edge of the plexiglass sheet 11 is also chamfered. Thus, when a portion of the strip 17 is depressed manually, the adjacent counter 13 is free to slide up the ramp formed by the portion of the strip 17 with the relative chamfers providing a substantially smooth path. With the dimensions of the example shown wherein the apparatus is 7½ inches square, each counter is of the order ⅞ of an inch and hence it will be appreciated that each portion of the strip 17 can be readily depressed by a finger or thumb without interfering with the next adjacent portion. In addition, a further counter can be placed upon one of the portions of the strip 17 thus depressing the portion and providing a ramp by which the additional counter can be slid downwardly thus contacting the outermost counter in a row or column. Provided the portion of the strip 17 at the opposite end of the row or column is also depressed, the additional counter at the first end can be slid into the row or column thus ejecting the counter at the opposite end making it a free or additional counter. Thus it will be appreciated that the pattern or configuration of counters can be shifted by one movement at a time caused by inserting one additional counter into a row or column and taking up the ejected counter. The apparatus therefore can be used for word games or coloured pattern games depending upon the surface characteristics of the counters. For example, counters can be provided in four colours initially in random orientation and can be gradually shifted by the skill of the player into any one of a number of chosen patterns.

The plate 11 is mounted relative to the plate 12 in parallel spaced relationship by eight tags as shown in FIG. 1 attached at the corners and midpoints of the plate 11. The tags are indicated at 20 and are attached by, for example, adhesive. They are small enough in size to avoid obscuring vision on the pattern or configuration of the counters and are chamfered at the lower edge to avoid obstructing movement of the counters 13.

Figure 3:
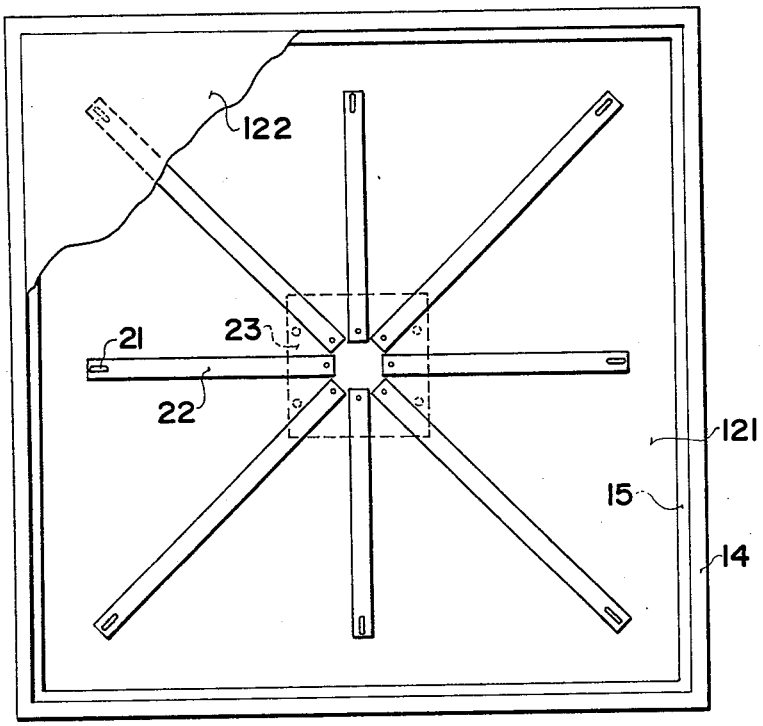
FIG. 3 is a view from the rear through the base showing the springs by which the upper plate is held in position relative to the base.

Referring now in addition to FIG. 3, each tag 20 is secured to a respective one of a plurality of leaf springs 22 which extend radially from an anchor plate 23 connected to the main body 121 and curve downwardly away therefrom. Thus the plate 11 is connected to the plate 12 flexibly allowing some movement for counters to be inserted and removed while applying pressure to the counters to maintain them in the set pattern or configuration.

A sheet of wood 122 is provided at the bottom of the box, in contact with the retaining strip 15 and co-extensive with the main body 121, to cover the springs 22. As can be seen from FIG. 1, the portions of the strips 17 which are adjacent the ends are reduced in length so as to be further spaced from the edge of the respective block. In addition, space is provided beneath the strips 17 to store additional blocks for use in the game.

It will be noted in addition that the adjacent surfaces of the plates 11 and 12 are plain and thus define no set channels or tracks for the counters. In this way, they are free to move simply in the paths defined by their own columns and rows and limited by the strips 17. In addition the counters 13 are of a simple form, that is, merely a substantially flat counter or regular or square upper surface and of height substantially less than the other two dimensions.

Since various modifications can be made in our invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

What we claim as our invention:

1. A board game apparatus comprising a first plate and a second plate, means mounting the plates in parallel and spaced relation, a plurality of separate square blocks which can be mounted between the plates in rows and columns such that in turn each row and each column of such blocks can be moved along its length by the introduction of a further block at one end to eject a block at the other end and trap means arranged at the end of each column and each row normally retaining the blocks in position between the plates, which trap means is individually manually movable to a release position to allow a block to be inserted into the plates and to allow a block to be ejected from between the plates.

2. Apparatus according to claim 1 wherein the trap means is movable to the release position in a direction substantially at right angles to the plates.

3. Apparatus according to claim 2 wherein the trap means comprises a flexible sheet, one edge of which is arranged to normally contact the edge of the adjacent block, which sheet can be flexed towards one of the plates to allow a block to slide over the surface thereof adjacent the other plate.

4. Apparatus according to claim 3 wherein the trap means comprises a plurality of strips of flexible material, each strip being arranged adjacent a portion of the edge of the plates such that the strips together fully surround the plates and wherein the strips are partially cut in a direction parallel to the movement of the adjacent block so as to form individually flexible portions with each portion cooperating with a respective one of the blocks.

5. Apparatus according to claim 4 wherein the strips comprise strips of ceramic laminate material.

6. Apparatus according to claim 3 wherein the flexible sheet is chambered on one surface at the edge adjacent the respective block so as to allow ready sliding movement of the block relative to the sheet.

7. Apparatus according to claim 2 wherein one plate extends outwardly beyond the extremity of the other plate so as to define with said trap means a space for storing additional blocks.

8. Apparatus according to claim 1 including a wall extending at right angles to the plates and enclosing the plates and the trap means so as to define a box arrangement therefor.

9. Apparatus according to claim 8 wherein one of the plates extends outwardly beyond the extremities of the other plate and is connected to the wall.

10. Apparatus according to claim 1 wherein the blocks are dimensioned such that the height thereof is substantially less than the other two dimensions.

11. Apparatus according to claim 1 including resilient means for biasing the plates into contact with the blocks.

12. Apparatus according to claim 11 wherein the resilient means comprises a plurality of leaf springs attached to one plate adjacent a midpoint thereof and attached to the other plate adjacent the extremities thereof.

13. Apparatus according to claim 1 wherein one plate is transparent.

14. Apparatus according to claim 1 wherein the adjacent surfaces of the plates are plain.

* * * * *